United States Patent [19]

Miyamori et al.

[11] 4,119,082

[45] Oct. 10, 1978

[54] SUBAQUEOUS HEATER APPARATUS

[75] Inventors: Katsuya Miyamori, 4-22-7, Ryouke, Urawa, Saitama, Japan; Toru Murai, Kanagawa; Osamu Shitamori, Yokohama, both of Japan

[73] Assignee: Katsuya Miyamori, Japan

[21] Appl. No.: 781,414

[22] Filed: Mar. 25, 1977

[30] Foreign Application Priority Data

Mar. 26, 1976 [JP] Japan ..... 51/33234

[51] Int. Cl.[2] ..... F24J 1/02

[52] U.S. Cl. ..... 126/263; 44/3 B

[58] Field of Search ..... 126/263; 62/4; 165/46; 44/3 R, 3 A, 3 B; 128/399, 403

[56] References Cited

U.S. PATENT DOCUMENTS

| | | | |
|---|---|---|---|
| 2,388,466 | 11/1945 | Caldwell | 126/263 |
| 3,906,926 | 9/1975 | Staples | 126/263 |
| 3,942,511 | 3/1976 | Black et al. | 126/263 |

*Primary Examiner*—Ronald C. Capossela

*Attorney, Agent, or Firm*—Beall & Jeffery

[57] ABSTRACT

A subaqueous heater apparatus of simple construction adapted for use by a human diver who in underwater activities needs to maintain his vital warmth. The apparatus contains uncombined calcium which under the gradual, controlled supply of water effects chemical reaction with evolution of heat. The supply of such water into the apparatus by capillary action is so controlled that the apparatus serves as an optimum body-warmer to the diver.

10 Claims, 5 Drawing Figures

SUBAQUEOUS HEATER APPARATUS

This invention relates to a subaqueous heater apparatus adapted for use by a human diver.

According to the conventional heater apparatus designed for a diver, there has usually been employed an electric heating system wherein through his electric heating suit having heating wires embedded in it, the diver in underwater action receive necessary power from his tender boat so as to maintain his vital warmth. Alternatively, a hot fluid system has also been in use whereby the diver maintains his vital warmth under the supply of warm water conducted through a diving suit he wears from his tender boat. With any of those heating apparatus for diver's use, however, the provision of plural unbilical cords in the form of electric wires or cables, or hoses is necessary because of its energy source being located on the diver tender. This has caused the diver to be restricted of his maneuvering motion to a considerable extent, and besides, has complicated in structure or enlarged in size the whole apparatus system, resulting thus in increase of manufacture cost.

This invention, therefore, is directed to eliminate such problems as encountered in the conventional apparatus by providing a novel subaqueous heater apparatus.

The principal object of the invention is to provide a subaqueous heater apparatus of the type which dispenses with electric wires, hoses, etc.

A further object is to provide a subaqueous heater apparatus or remarkably simple construction.

Yet a further object is to provide a subaqueous heater apparatus which itself performs a self-heating function.

A further object is to provide a subaqueous heater apparatus in which the self-heating function is effected by use of a chemically reactable member.

The basic concept on which the invention relies and preferred embodiments of the invention will now be described with reference to the accompanying drawings: wherein FIG. 1 is a perspective view showing one embodiment of the invention;

As is known, uncombined calcium is characterized by its chemical action upon water as shown in the following formula:

$$Ca + 2H_2O \rightarrow Ca(OH)_2 + H_2 \quad (1)$$

That is, uncombined calcium Ca acts upon water hence producing calcium hydroxide, $Ca(OH)_2$ and hydrogen, $H_2$. Heat is generated in the course of this reaction. Accordingly, there can be provided a kind of heat generating means through an appropriate arrangement of a heat agent of uncombined calcium, Ca being supplied with water, $H_2O$.

According to the invention, there is provided a container or canister which stores in it uncombined calcium Ca and forms an inlet means to let in water, $H_2O$. The canister also forms an outlet means to release hydrogen gases, which have been produced through a chemical reaction between Ca and $H_2O$, outwardly of the canister. The inlet means is particularly designed so that no direct or uncontrolled flow-in of water into the canister may take place. This design consideration is necessary due to the fact that if water enters the canister directly or uncontrollably, there will take place vigorous or uncontrolled reaction over a considerable volume of two substances in direct contact thus resulting in occurrence of an excessive heat evolution. The particular design, therefore, is necessarily called for as to the arrangement of the water inlet means so as to permit water to flow in little by little as predetermined.

Figure 1:
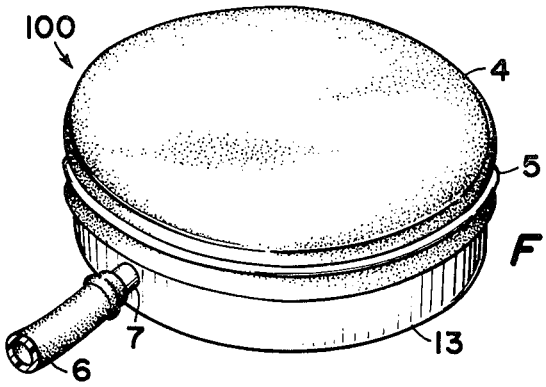
Figure 2:
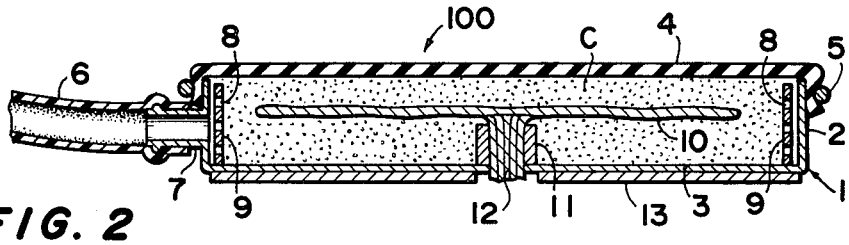
FIG. 2 is a longitudinal sectional view of FIG. 1 showing the inner arrangement of the invention.

In FIGS. 1 and 2 which show a first embodiment of the invention, the subaqueous heater apparatus 100 according to the invention is in the form of a shallow canister having rubber plates 4 and 13 applied on the upper and lower faces and a tube 6 attached sidewise as extending outwardly. The canister proper 1 is of a shallow cylinder made of sheet metal composed of a side wall 2 and bottom plate 3. From a view of its best use for a human diver, the canister is dimension approximately 100 mm × 13 mm, its cubic capacity being about 100 cc. Around the canister proper 1, is fixed a rubber plate 4 as an upper lid water-tight relative to the side wall 2 by means of a snap wire, etc. 5. A pipe 7 fittable in the vinyl tube 6 is formed as protruding sidewise from the wall 2, also water tight, as part of an outlet means. Within the canister is provided an inner wall of metal 9 having a plurality of holes 8 of about 1 mm in diameter and spaced about 1 mm to 2 mm from the side wall 2. This annular inner wall 9 is flush with or slightly lower than the side wall 2. An outlet passage means for hydrogen gases is constituted with the holes 8, annular space defined between the side wall and inner wall, and pipe 7.

In the main compartment defined by the inner wall 9, bottom plate 3 and rubber plate 4, is stored a filler of calcium grains C. Inside this filler of calcium is fixed a water absorbing member 10 of absorbent cotton, etc. in the form of a thin disk. A small pipe 11 of about 6 mm in inner diameter and 6 mm in length is attached around a hole in the middle of the bottom plate 3 in a water-tight manner by soldering, etc. Inside this pipe 11 is closely filled absorbent cotton or gauze in the form of a wick 12. The wick 12 has one end extended out from the canister and the other end substatially connected at the middle of the absorbent member 10. The bottom plate 3 is applied, except were the wick extends through, with the rubber plate 13, so that the extreme end portions of the wick 12 is emersed in water when the apparatus is in underwater use.

With the above construction, it is contemplated in use that water outside the appartus soaks through the wick 12 into the absorbent member 10 little by little. In consequence, the water sucked in the absorbent member 10 initiates a chemical reaction upon contact with the uncombined calcium filler C to produce reaction heat, which heat is tranmitted outwardly from the rubber plates 4 and 13. Meanwhile, hydrogen gases being produced through the reaction are conducted through the holes 8 of the inner wall 9, annular space between the walls 9 and 2, and pipe 7 to be released outside the apparatus.

The heater apparatus 100 described above will now be further eluridated with respect to its optimum adaptability in use for a human diver to keep its vital warmth.

The wet suit to be worn by the diver generally consists of an upper garment and undergarment in twopiece. The wet suit is made of spongy rubber of neoprene, etc. With this kind of wet suit, the wearer may advantageously avoid a loss of his bodily temperature thanks to the effect of heat insulation by rubber materials, and also prevent the so-called "squeeze" which means oppression of the wearer's body by compressed space between the body and suit under the influence of water paressure acting therein. Normally, the undergarment covers the wearer's legs, abdomen and breast while the upper garment covers neck, arms, breast, waist and hip.

In practice, the diver mounts two of the heater apparatus of the invention respectively applied around his back and belly between the upper and lowr garments in a manner that the vinyl tube of each apparatus extends outwardly from the suit as secured at his waist belt. When the diver goes underwater, water natually enters into the space between the suit and his body, increasingly especially around the space where the apparatus are mounted. A portion of water adjacent the heater apparatus is sucked in through the wick 12 to the absorbent member 10 so that there takes place a chemical reaction between the water and calcium grains C. Heat and hydrogen gases are thus produced while the uncombined calcium C turns to calcium hydroxide.

The heat thus produced is released for its most part through the side wall of the canister where no rubber plate is applied, and heats up a volume of ambient water around the apparatus, which hot water then circulates around the diver's abdomen and breast thus keeping the bodily warmth of the wearer. On the other hand, the hydrogen gases produced are conducted through the holes 8 of the inner wall 9, annular space between the walls 9 and 2, and vinyl tube 6 to be discharged outside the apparatus.

Next, the invention will be described as to how it operates satisfactorily especially for subaqueous use. As described earlier, the provision of the vinyl tube 6 is for release of hydrogen gases outside the wet suit worn by the diver. The reactor canister, therefore, is basically of equal pressure relationship between its inside and outside. However, the situation may arise depending on an underwater posture of the diver or fluid resistance of the hydrogen gases or location of the exit end of the vinyl tube relative to the canister 1 that the inner pressure of the reactor cansiter shows slightly higher than the water pressure at the gas exit. To force water in the canister through the pipe 11 under such pressure conditions, it is necessary to provide an external pressure overcoming the higher inner pressure present in the canister, for example by use of a manual pump or its like. However, this extra provision for the forced supply of water against the pressure difference results in exaggeration of the apparatus or multiplicaton of necessary parts. According to the invention, in clear contrast, the supply of water into the canister under such adverse pressure difference is made possible with a simplified mode of construction.

More specifically, this feature of the invention resides in the provision of the wick 12 and adsorbent member 10 which absorb water in gradual manner as if water in the ground is infiltrated or sucked up through roots, trunk and brranches of a tree. The chemical reaction between water and calcium deprives the absorbent member of its water contents, which member then is compensated for water from the wick. This continuous suction of water is well known as a capillary phenomenon, and by use of capillarity adverse difference of pressure between the inside and outside of the canister may sufficiently be overcome. According to the invention, the outside water reaches little by little at the absorbent member 10 through the wick 12. Since the rate of water absorption by the wick 12 is substantially constant, it is assured that a predetermined volume of water be fed in through the wick 12 and absorbent member 10 thus rendering the rate of chemical reaction also constant. In other words, the rate or speed of reaction is controllable by selected arrangements of the wick 12 and absorbent member 10.

It is noted that the more the supply of wter is conducted or the higher the temperature inside the canister is, the greater the rateof reaction between calcium and water becomes. To maintain a constant rate of reaction or heat generation, therefore, the inner temperature of the reactor canister has only to be kept as constant as possible since the supply of water has been kept at a constant rate. The upper limit of water temperarure at atmospheric pressure is about 100° C, and to maintain the inner temperature of the canister in the vicinity of 100° C, the canister is applied on the upper and lowr faces with rubber plates according to the embodiment of the invention.

The provision of the inner wall works well to avoid losses of heat in the sidewise direction while preventing cloggings of uncombined calcium, which has completed the chemical reaction, around the gas exit of the vinyl pipe.

Further, as the diver moves differently from depth to depth, the heater apparatus is subjected to varieties of water pressure. In this consequence, it may happen that hydrogen gases staying in a dead space of the canister are compressed under water pressure and reduce their volume. In case this reduced volume should not be compensated by the hydrogen gases being produced, there may be the possibility of water flowing through the vinyl tube into the canister. This reverse flow results in unduly rapid reaction in the canister, and when such flow occurs, the life of the heater apparatus will be shortened. The factors to be considered for prevention of this adverse flow-in of water will be described.

Upon completion of the chemical reaction, uncombined calcium turns to calcium hydroxide, whereby its volume is increased. The canister itself, therefore, has to be of a volumetric capacity enough to compensate this increase. With a rigid canister of 140 cc in capacity for example, it is possible to fill about 55 g of uncombined calcium. The capacity of heat production of 55 g calcium is about 100W × 60 minutes, while the generation of hydrogen gases is proportional to that of heat viz. in this instance about 7 cc/sec at 100W. With the above filling of calcium in the canister, it is presumed that there is provided a dead space of about 80 cc. Suppose that the diver takes 6 seconds to descend in water as deep as 10 m (2 atom) from the surface, the volume of hydrogen gases staying in the dead space meanwhile is reduced to half under compression. Hence, unless the canister is supplemented with the same quantity or 80 cc of gases, there will be risks of external water flowing in the canister through the outlet of vinyl tube. The volume of hydrogen gases produced meanwhile through the reaction is 7 cc × 6 seconds = 42 cc, which is smaller than 80 cc. Thus, the reverse flow-in of water takes place. To remedy this adverse situation, a recommendation is made to change the design specification of the wick and absorbent member so that the capacity of the heater apparatus shows 200W × 30 minutes with evolution of hydrogen gases at a rate of 14 cc/sec hence 84 cc of hydrogen gases being produced in 6 seconds. In this manner, it is made possible to prevent the reverse flow of external water into the canister.

There will be given an alternative way to prevent the reverse flow-in of water.

As shown in the drawings, the calcium grains C of 55 g is stored in the canister of 100 cc having the lid 4 made of deformable rubber. The volumetirc expansion of calcium grains upon completion of the reaction can be absorbed by the deformation of the rubber lid 4 thus rendering the dead space small in size. Hence, the occurrence of reverse flows can be avoided.

Figure 3:
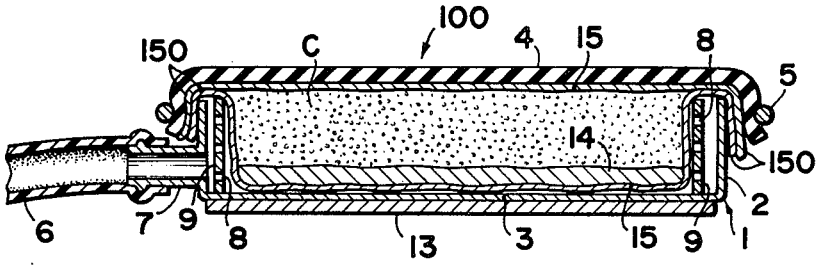
FIG. 3 is a longitudinal sectional view of another embodiment of the invention.

FIG. 3 shows another embodiment of the invention, which in contrast with the first practice of FIGS. 1 and 2, has employed an altered water inlet means while omitting the wick 12 and its associated parts. This inlet means or water absorbent means includes a water absorbing member 14 of absorbent cotton, etc. in the form of a disk disposed adjacent the bottom 2 of the canister 1, upon which absorbent disk 14 is placed a filler of calcium grains C. Both are within the space defined by the inner wall 9. Further, both of the two members described are wrapped up by receiving gauzes 15. The gauzes 15 are arranged so that their rising or peripheral portions extend alongside the side edge of the canister with the extreme ends 150 protruding out of the canister 1. Around the extreme ends 150 of the gauzes 15, is applied the rubber plate 4 pressed by means of a snap wire 5 to provide water-tightness.

According to this construction, wherein the end portions 150 of the gauzes 15 act as wicks, the same operation and effect as described with reference to FIGS. 1 and 2 are equally obtained, the offering of an optimum type of subaqueous heater apparatus for use by a human diver. In this embodiment, it will be appreciated that the provision of the inner wal 9 can be omitted since the wrapping gauze 15 serves as its substitute especially where the heater apparatus is a throwaway article.

Figure 4:
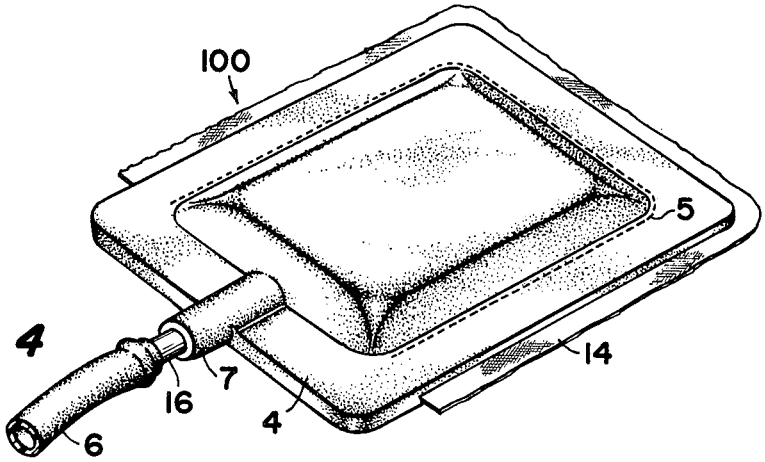
FIG. 4 is a perspective view showing still another embodiment of the invention.
Figure 5:
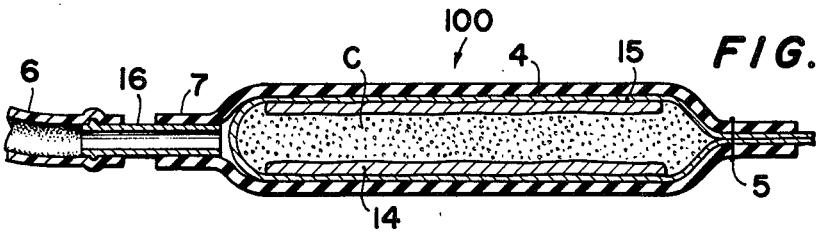
FIG. 5 is a longitudinal section view of FIG. 4.

FIGS. 4 and 5 show still another embodiment of the invention, wherein the filler of calcium grains C is wrapped by a gauze bag 15 with absorbent members 14, both of which being sandwitched in a split-type canister. The wick end portion is tightened at 5 by sewing, etc.

It is to be noted that although the invention has been described as employing a water absorbing member of absorbent cotton and a wick of gauze, they are not necessarily limited to those but may equally be alternative materials e.g. fibers; chemical fibers, etc. Also, any exothermic reactive materials other than uncombined calcium may be used if only they react upon water, the invention having been described with the material of uncombined calcium, however. Magnesium is one example. Of course, the use of uncombined calcium is most optimum in the light of economy, reactive speed, stability, etc. attainable.

The heater apparatus of the invention is very compact and of simple construction whle dispensing with any external power supply or opeating instructions by way of varied umbilical means e.g. electric wirings, codes, fluid conducting tubes, pumps, etc. In use, the invention can be of the throwaway type, and its most effective use is directed to a human diver who hasto maintain his vital warmth during underwater activities. Normally, the loss of human bodily warmth is below about 100W when out of motion. The use of two heaters of the invention of a little over 100W each, therefore, suffices to maintain the vital warmth of the diver. In case of use in an extremely low-temperature water, say 0° C to 5° C, more than two sets of apparatus will be used to make the heating effect substantially uniform all over. In fact, the invention proved best suited to use in a 3ater of 10° C to 15° C in temperature.

The invention may be applied also to other industrial fields e.g. provision of hot water by the inventin in combination with a heat exchanger.

We claim:

1. A subaqueous heater apparatus, comprising: a generally water-tight container; a substance within said container that will exothermically chemically react with water; a water absorbent member within said container and in contact with said substance; and means to supply said absorbent member in the container with water from outside the container by capillary action, so that the heat evolved upon the chemical reaction between said substance and water supplied to said absorbent member by said means is used as the heat source for the heater apparatus.

2. The apparatus of claim 1, wherein said container includes at least one wall constructed of elastomeric material so as to provide an expansible chamber within said container having therein the substance to compensate for volumetric changes during the chemical reaction.

3. The apparatus of claim 2, wherein said means includes a wicking material extending through said container and being in contact with said absorbent member within said container at one end and open to the environment exterior of said container at its opposite end.

4. The apparatus of claim 1, wherein said means includes a wicking material extending through said container and being in contact with said absorbent member within said container at one end and open to the environment exterior of said container at its opposite end.

5. A subaqueous heater apparatus, comprising: a generally water-tight container; uncombined calcium within said container that will exothermically react with water to produce heat and hydrogen gas; a water absorbent member within said container and in contact with said uncombined calcium; said container having a hydrogen gas outlet formed to discharge externally the hydrogen gases evolved through the reaction between said uncombined calcium and water; and capillary means for automatically trasmitting water from outside said container to said absorbent member within said container so that hydrogen gases evolved in the chemical reaction betwen water supplied to the absorbent member by said capillary means and said uncombined calcium is discharged from said hydrogen outlet while heat evolved upon said reaction is used as a heat source for the heater apparatus.

6. The apparatus of claim 5, wherein said container provides at least in part a volume expanding means of elastomeric material to compensate for volumetric expansio attained by said uncombined calcium being replaced with calcium hydroxide during the reaction with water.

7. The apparatus of claim 6, wherein said volume expanding means is one wall of said container being constructed of elastomeric material.

8. The apparatus of claim 7, wherein said capillary means is a wick extending through said container andin contact at one end with said absorbent member and at its opposite end being exposed to the environment exterior of said container.

9. The apparatus of claim 5, wherein said container has a peripheral side wall, and further including an aperatured partition wall separating said uncombined calcium from said peripheral side wall and being spaced from said peripheral side wall to provide a peripheral chamber for collecting hydrogen gases passing through the aperatures of said partition; said hydrogen outlet being in direct fluid communication with said peripheral chamber.

10. The apparatus of claim 5, wherein said capillary means is a wick extending through said container and in contact at one end with said absorbent member and at its opposite end being exposed to the environment exterior of said container.

* * * * *